United States Patent [19]

Yamashita et al.

[11] Patent Number: 4,987,846

[45] Date of Patent: Jan. 29, 1991

[54] FLOATING STRUCTURE

[75] Inventors: Seiya Yamashita, Yokohama; Haruo Sasaki, Tokyo, both of Japan

[73] Assignee: Ishikawajima-Harima Jukogyo Kabushiki Kaisha, Japan

[21] Appl. No.: 463,944

[22] Filed: Jan. 8, 1990

Related U.S. Application Data

[63] Continuation of Ser. No. 230,179, Aug. 9, 1988, abandoned.

[30] Foreign Application Priority Data

Aug. 21, 1987 [JP] Japan ..... 62-126331

[51] Int. Cl.[5] ..... B63B 35/08

[52] U.S. Cl. ..... 114/265; 114/264; 114/266; 114/267

[58] Field of Search ..... 114/264–267, 114/230, 40; 441/1; 405/195, 211, 212, 200

[56] References Cited

U.S. PATENT DOCUMENTS

| | | | |
|---|---|---|---|
| 2,763,868 | 12/1960 | Armstrong | 114/265 |
| 3,163,147 | 12/1964 | Collipp | 114/265 |
| 3,207,110 | 9/1965 | Laborde | 114/265 |
| 3,347,052 | 10/1967 | Steitle | 114/265 |
| 3,669,052 | 6/1972 | Schirtzinger | 114/264 |
| 3,759,046 | 9/1973 | Anders | 114/265 |
| 4,063,428 | 12/1977 | Waas | 114/40 |
| 4,117,691 | 10/1978 | Spray | 114/264 |
| 4,343,055 | 8/1982 | Bergling | 114/264 |
| 4,406,243 | 9/1983 | Kim | 114/264 |
| 4,556,008 | 12/1985 | Copson | 114/265 |
| 4,565,149 | 1/1986 | Clasky | 114/264 |
| 4,578,000 | 3/1986 | Lindqvist | 114/40 |
| 4,627,767 | 12/1986 | Field | 114/264 |
| 4,869,192 | 9/1989 | Pawolski | 114/265 |

*Primary Examiner*—Joseph F. Peters, Jr.
*Assistant Examiner*—Clifford T. Bartz

[57] ABSTRACT

A column belt is between upper and lower reduced-diameter columns and is only in the vicinity of and across the water surface so that the heave resonant period is increased which is due to the effect of the shape of the column belt.

2 Claims, 2 Drawing Sheets

FLOATING STRUCTURE

This application is a continuation of application Ser. No. 230,179, filed Aug. 9, 1988, now abandoned.

BACKGROUND OF THE INVENTION

The present invention relates to a floating offshore structure and more particularly a floating offshore structure of a semisubmersible type such as a drilling rig for crude oil production or a marine leisure facility which is so designed and constructed to decrease its heaving motion in waves.

A floating structure as shown in FIG. 1 is well known in the art.

In FIG. 1, reference numeral 11 designates water surface; 12, column; 13, a constricted or reduced-diameter part; 14, a floater; and 15, a deck. The following relation must be satisfied:

$$d_3 > d_1 > d_2$$

wherein $d_1$: diameter of the column 12;

$d_2$: diameter of the reduced-diameter part 13; and $d_3$: diameter of the floater 14.

The conventional floating structure with the reduced-diameter part 13 described above has such a shape that it will receive no vertical wave-induced force at two wave periods, that is, at a considerably short wave period and at a relatively long wave period, whereby the heaving motion of the floating structure is decreased over a wide range of wave period.

However, when the upper column 12 is increased in diameter $d_1$ to provide the reduced-diameter part 13, there arises the problem that heave resonant period becomes shorter since the column 12 has the larger diameter $d_1$ at the cross section thereof defined by the water surface 11 and extends, without changing its diameter, up to the deck 15.

The present invention has for its object, therefore, to overcome the above and other problems encountered in the conventional offshore structures.

the above and other objects of the present invention will become more apparent from the following description of preferred embodiments thereof taken in conjunction with the accompanying drawings.

DETAILED DESCRIPTION OF THE PREFERRED EMBODIMENTS

Figure 2:
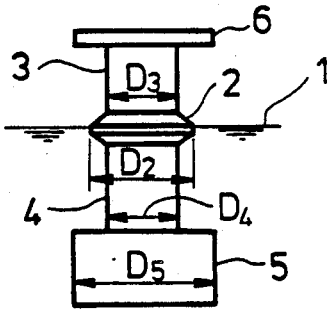
FIG. 2 is a front view of a first embodiment of the present invention.

Referring now to FIG. 2 illustrating a first embodiment of the present invention, reference numeral 1 designates water surface; 2, a column belt extending circumferentially outwardly in the form of ring; 3, an upper column; 4, a lower column; 5, a floater; and 6, a deck. $D_2$ denotes diameter of the column belt 2; $D_3$, diameter of the upper column 3; $D_4$, diameter of the lower column 4; and $D_5$, diameter of the floater 5.

More specifically, the floating structure has the column belt 2 which is in the vicinity of and across the water surface 1 as well as the upper and lower columns 3 and 4 which extend respectively upwardly and downwardly from and are integral with the column belt 2. It further includes the floater 5 extending downwardly from the lower column 4 as well as the deck 6 disposed on the upper column 3. The diameter $D_3$ of he upper column 3 is equal to the diameter $D_4$ of the lower column 4. The diameter $D_2$ of the column belt 2 is greater than the diameters $D_3$ and $D_4$ of the upper and lower columns 3 and 4, but is smaller than the diameter $D_5$ of the floater 5; that is, the following relation must be satisfied:

$$D_5 > D_2 > D_3 = d_4$$

The floating structure with the construction as shown in FIG. 2 has the lower column 4 which is a submerged component below the water surface 1 substantially similar in shape to the reduced-diameter part 13 of the conventional floating structure shown in FIG. 1 so that, as is the case of the prior art, the lower column 4 reduces the vertical wave-induced force over a wide range of shorter wave periods and consequently the heaving motion of the floating structure in waves becomes less. In the range of long wave periods, the heaving motion of the floating structure is increased so that exposure of the column belt 2 above and submersion thereof below the water surface 1 are repeated. In this case, even when the diameter at the water surface is large, its effect on the heave resonant period is less. Therefore, according to the present invention the heave resonant period becomes longer than that of the conventional floating structure shown in FIG. 1.

Figure 1:
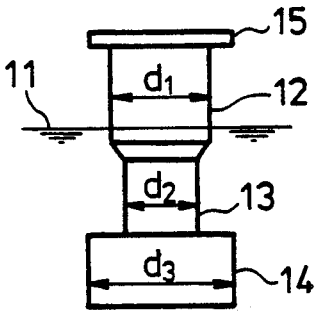
Fig. 1 PRIOR ART
FIG. 1 is a front view of a conventional floating offshore structure.
Figure 3:
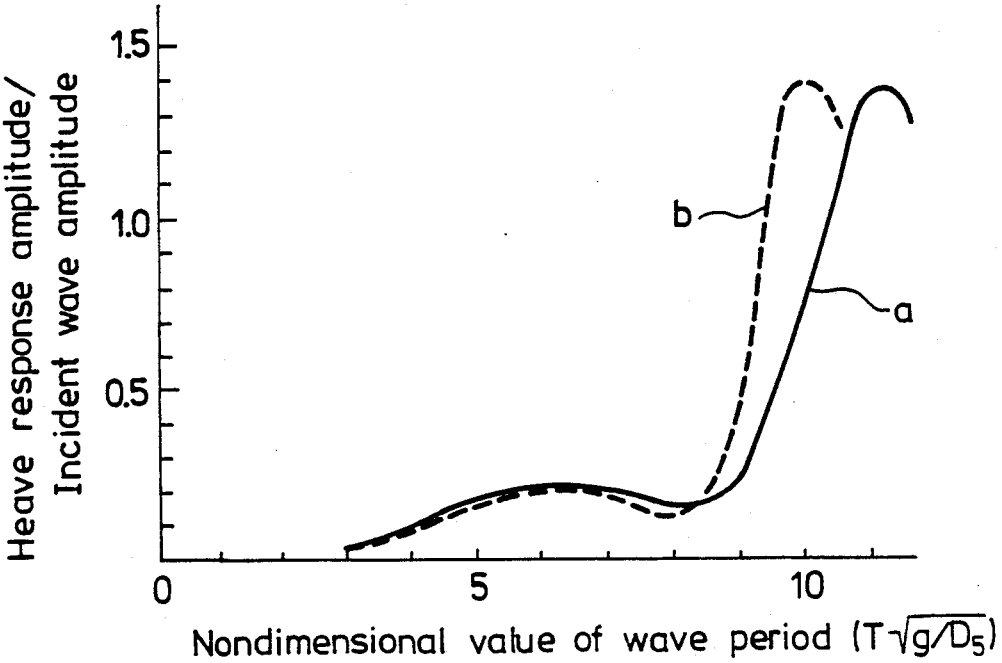
FIG. 3 is a graph used to comparatively explain the results of response tests in waves.

FIG. 3 shows heave response amplitude obtained by the response tests of the floating structure of the conventional type shown in FIG. 1 and in accordance with the present invention shown in FIG. 2 conducted in regular waves. In FIG. 3, plotted along the ordinate is ratio $(Z_A/\zeta_A)$ of the heave response amplitude to the incident wave amplitude while the nondimensional value of the wave period T is plotted along the abscissa. Solid-line curve a is obtained in the case of the floating structure according to the present invention shown in FIG. 2 while the broken-line curve b, in the case of the conventional floating structure shown in FIG. 1.

As is apparent from the solid-line curve a, in the range of the shorter wave periods, the heave response amplitude of the floating structure according to the present invention are substantially equal to those indicated by the broken-line curve b of the conventional floating structure shown in FIG. 1 and the heave resonant period is improved compared with that of the conventional floating structure.

Figure 4:
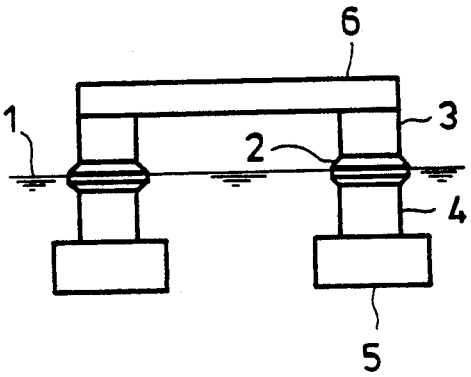
FIG. 4 is a front view of a second embodiment of the present invention.
Figure 6:
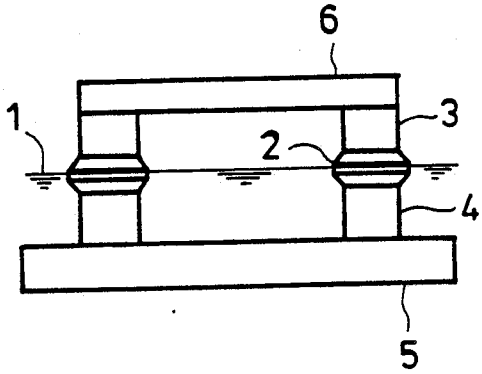
FIG. 6 is a front view of a third embodiment of the present invention.
Figure 5:
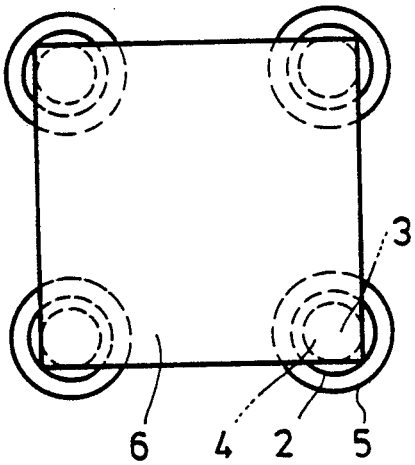
FIG. 5 is a top view thereof.
Figure 7:
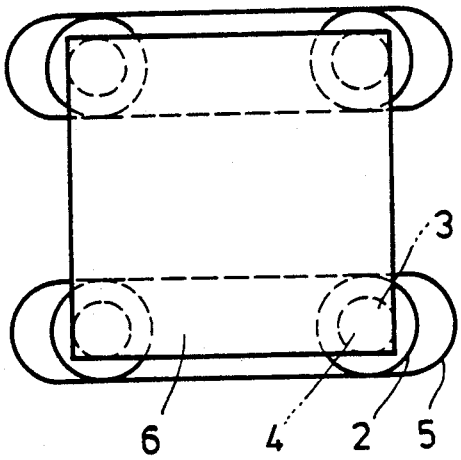
FIG. 7 is a top view thereof.

FIGS. 4 and 5 show a second embodiment of the present invention while FIGS. 6 and 7, a third embodiment thereof.

The present invention is applied, in the second embodiment, to a column-footing type marine structure comprising a plurality of axis symmetric floating bodies and in the third embodiment, to a lower hull type marine structure. The second and third embodiments are being illustrated to have no braces; but it is to be understood that the present invention may be equally applied to structure with braces.

In the case of the floating structure according to the present invention, the larger-diameter portion at the water surface is only within the vicinity of and across the water surface to provide a column belt; the diameter of the upper column extending upwardly from the column belt is made substantially equal to that of the lower column which is submerged and corresponds to the conventional reduced-diameter part so that like the conventional floating structures the heaving motion in waves is small in the range of shorter wave period and the heave resonant period becomes longer than that of the conventional floating structure in the range of longer wave period.

What is claimed is:

1. A floating structure comprising a deck and four supports for supporting said deck above the water surface, each of said supports comprising a column belt only in the vicinity of and across the water surface, said column belt having no opening therein, an upper column extending upwardly from said column belt and integrally attached thereto and having its upper end integrally attached to said deck, a lower column extending downwardly from said column belt and integrally attached thereto, and a floater below said lower column, diameters of said upper and lower columns being substantially equal to each other, diameter of said column belt being greater than those of said upper and lower columns.

2. The structure according to claim 1 wherein diameter of said floater is greater than that of said column belt.

* * * * *